US007458257B2

(12) United States Patent
Pop et al.

(10) Patent No.: US 7,458,257 B2
(45) Date of Patent: Dec. 2, 2008

(54) DOWNHOLE MEASUREMENT OF FORMATION CHARACTERISTICS WHILE DRILLING

(75) Inventors: Julian J. Pop, Houston, TX (US); Reza Taherian, Sugar Land, TX (US); Martin E. Poitzsch, Derry, NH (US); Jacques R. Tabanou, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 351 days.

(21) Appl. No.: 11/312,683

(22) Filed: Dec. 19, 2005

(65) Prior Publication Data

US 2007/0137293 A1 Jun. 21, 2007

(51) Int. Cl.
*E21B 47/00* (2006.01)

(52) U.S. Cl. ..... 73/152.04; 73/19.09

(58) Field of Classification Search ..... 73/152.04, 73/19.09

See application file for complete search history.

(56) References Cited

U.S. PATENT DOCUMENTS

| | | | | | |
|---|---|---|---|---|---|
| 3,802,260 | A | * | 4/1974 | Kishel | 73/152.04 |
| 3,814,183 | A | | 6/1974 | Kishel | |
| 4,223,746 | A | * | 9/1980 | Tanguy et al. | 175/40 |
| 4,536,713 | A | * | 8/1985 | Davis et al. | 324/324 |
| 4,635,735 | A | * | 1/1987 | Crownover | 175/48 |
| 4,739,654 | A | | 4/1988 | Pilkington et al. | |
| 4,754,641 | A | | 7/1988 | Orban et al. | |
| 4,833,915 | A | | 5/1989 | Radd et al. | |
| 4,887,464 | A | | 12/1989 | Tannenbaum et al. | |
| 4,994,671 | A | | 2/1991 | Safinya et al. | |
| 5,090,256 | A | | 2/1992 | Issenmann | |
| 5,165,275 | A | * | 11/1992 | Donovan | 73/152.04 |

(Continued)

FOREIGN PATENT DOCUMENTS

| | | |
|---|---|---|
| GB | 2 388 658 | 11/2003 |

(Continued)

OTHER PUBLICATIONS

P. Blanc et al., "Reducing Uncertainties in Formation Evaluation through Innovative Mud Logging Techniques," *SPE 84383*, SPE Annual Technical Conference and Exhibition, Denver CO, Oct. 5-8, 2003.

(Continued)

*Primary Examiner*—Robert R Raevis
(74) *Attorney, Agent, or Firm*—Dave Hofman; Matthias Abrell; Darla Fonseca

(57) ABSTRACT

A method for determining a property of formations surrounding an earth borehole being drilled with a drill bit at the end of a drill string, using drilling fluid that flows downward through the drill string, exits through the drill bit, and returns toward the earth's surface in the annulus between the drill string and the periphery of the borehole, including the following steps: obtaining, downhole near the drill bit, a pre-bit sample of the mud in the drill string as it approaches the drill bit; obtaining, downhole near the drill bit, a post-bit sample of the mud in the annulus, entrained with drilled earth formation, after its egression from the drill bit; implementing pre-bit measurements on the pre-bit sample; implementing post-bit measurements on the post-bit sample; and determining a property of the formations from the post-bit measurements and the pre-bit measurements.

34 Claims, 9 Drawing Sheets

U.S. PATENT DOCUMENTS

| | | | | |
|---|---|---|---|---|
| 5,306,909 | A | 4/1994 | Jones et al. | |
| 5,351,532 | A | 10/1994 | Hager | |
| 5,397,899 | A | 3/1995 | DiFoggio et al. | |
| 5,635,631 | A | 6/1997 | Yesudas et al. | |
| 5,859,430 | A | 1/1999 | Mullins et al. | |
| 6,176,323 | B1 | 1/2001 | Weirich et al. | |
| 6,178,815 | B1 | 1/2001 | Felling et al. | |
| 6,206,108 | B1 | 3/2001 | MacDonald et al. | |
| 6,218,662 | B1 | 4/2001 | Tchakarov et al. | |
| 6,274,865 | B1 | 8/2001 | Schroer et al. | |
| 6,343,507 | B1 | 2/2002 | Felling et al. | |
| 6,350,986 | B1 | 2/2002 | Mullins et al. | |
| 6,388,251 | B1 | 5/2002 | Papanyan | |
| 6,420,869 | B1 | 7/2002 | DiFoggio | |
| 6,443,001 | B1 | 9/2002 | Duriez et al. | |
| 6,474,152 | B1 | 11/2002 | Mullins et al. | |
| 6,476,384 | B1 | 11/2002 | Mullins et al. | |
| 6,490,916 | B1 | 12/2002 | Goodwin et al. | |
| 6,627,873 | B2 | 9/2003 | Tchakarov et al. | |
| 6,644,402 | B1 * | 11/2003 | Sharma et al. | 166/250.01 |
| 6,661,000 | B2 | 12/2003 | Smith et al. | |
| 6,670,605 | B1 | 12/2003 | Storm, Jr. et al. | |
| 6,683,681 | B2 | 1/2004 | DiFoggio et al. | |
| 6,714,872 | B2 | 3/2004 | DiFoggio et al. | |
| 6,755,086 | B2 | 6/2004 | Salamitou et al. | |
| 6,758,090 | B2 | 7/2004 | Bostrom et al. | |
| 6,768,105 | B2 | 7/2004 | Mullins et al. | |
| 6,798,518 | B2 | 9/2004 | DiFoggio et al. | |
| 6,850,317 | B2 | 2/2005 | Mullins et al. | |
| 6,854,341 | B2 | 2/2005 | Oddie et al. | |
| 6,860,325 | B2 | 3/2005 | Ramakrishnan et al. | |
| 6,871,532 | B2 | 3/2005 | Zazovsky | |
| 6,927,846 | B2 | 8/2005 | Smith et al. | |
| 2002/0178805 | A1 | 12/2002 | DiFoggio et al. | |
| 2003/0051602 | A1 | 3/2003 | Means | |
| 2003/0094575 | A1 | 5/2003 | Walkow | |
| 2003/0145988 | A1 | 8/2003 | Mullins et al. | |
| 2003/0163259 | A1 | 8/2003 | DiFoggio et al. | |
| 2003/0193662 | A1 | 10/2003 | DiFoggio et al. | |
| 2003/0209066 | A1 | 11/2003 | Goodwin | |
| 2003/0223068 | A1 | 12/2003 | DiFoggio et al. | |
| 2004/0007665 | A1 | 1/2004 | DiFoggio et al. | |
| 2004/0014223 | A1 | 1/2004 | Audibert et al. | |
| 2004/0089448 | A1 | 5/2004 | DiFoggio | |
| 2004/0104341 | A1 | 6/2004 | Betancourt et al. | |
| 2004/0104355 | A1 | 6/2004 | DiFoggio et al. | |
| 2004/0109156 | A1 | 6/2004 | DiFoggio et al. | |
| 2004/0139798 | A1 | 7/2004 | Haddad et al. | |
| 2004/0178336 | A1 | 9/2004 | DiFoggio | |
| 2004/0218176 | A1 | 11/2004 | Shammal et al. | |
| 2004/0236512 | A1 | 11/2004 | DiFoggio et al. | |
| 2004/0260497 | A1 | 12/2004 | DiFoggio et al. | |
| 2005/0007583 | A1 | 1/2005 | DiFoggio | |
| 2005/0018192 | A1 | 1/2005 | DiFoggio et al. | |
| 2005/0099618 | A1 | 5/2005 | DiFoggio et al. | |
| 2005/0133261 | A1 | 6/2005 | Ramakrishnan et al. | |
| 2005/0182566 | A1 | 8/2005 | DiFoggio | |
| 2005/0205256 | A1 | 9/2005 | DiFoggio | |
| 2005/0247119 | A1 | 11/2005 | DiFoggio et al. | |
| 2005/0262936 | A1 | 12/2005 | DiFoggio | |

FOREIGN PATENT DOCUMENTS

| | | |
|---|---|---|
| WO | WO 02/31476 A2 | 4/2002 |
| WO | WO 2004/003343 | 1/2004 |
| WO | WO 2005/065277 | 7/2005 |

OTHER PUBLICATIONS

A.O. Brumboiu, "Application of Semipermeable Membrane Technology in the Measurement of Hydrocarbon Gases in Drilling Fluids," SPEA/AAPG Western Regional Meeting, Long Beach CA, Jun. 19-23, 2000.

J.D. Edman et al., "Geochemistry in an Integrated Study of Reservoir Compartmentalization at Ewing Bank 873, Offshore Gulf of Mexico," *SPE Reservoir Eval. & Eng. 2* (6) Dec. 1999.

J. Breviere et al., "Gas Chromatography-Mass Spectrometry (GCMS)-A New Wellsite Tool for Continuous C1-C8 Gas Measurement in Drilling Mud-Including Original Gas Extractor and Gas Line Concepts. First Results and Potential," *SPWLA Ann. Symp.*, Jun. 2-5, 2002.

L. Ellis, et al. "Mud Gas Isotope Logging (MGIL) Assists in Oil and Gas Drilling Operations," *Oil & Gas Journal*, May 26, 2003.

Ja Haworth et al., "Interpretation of Hydrocarbon shows using Light (C1-C5) Hydrocarbon Gases from Mud-Log Data," Am. Ass'n Petr. Geologists Bulletin, v. 69, No. 8 (1985).

* cited by examiner

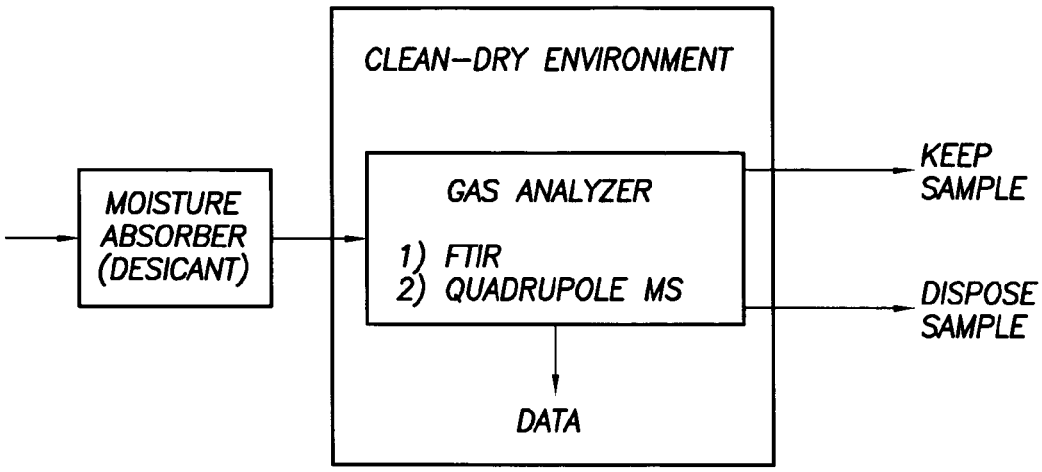
FIG.6
FIG.7
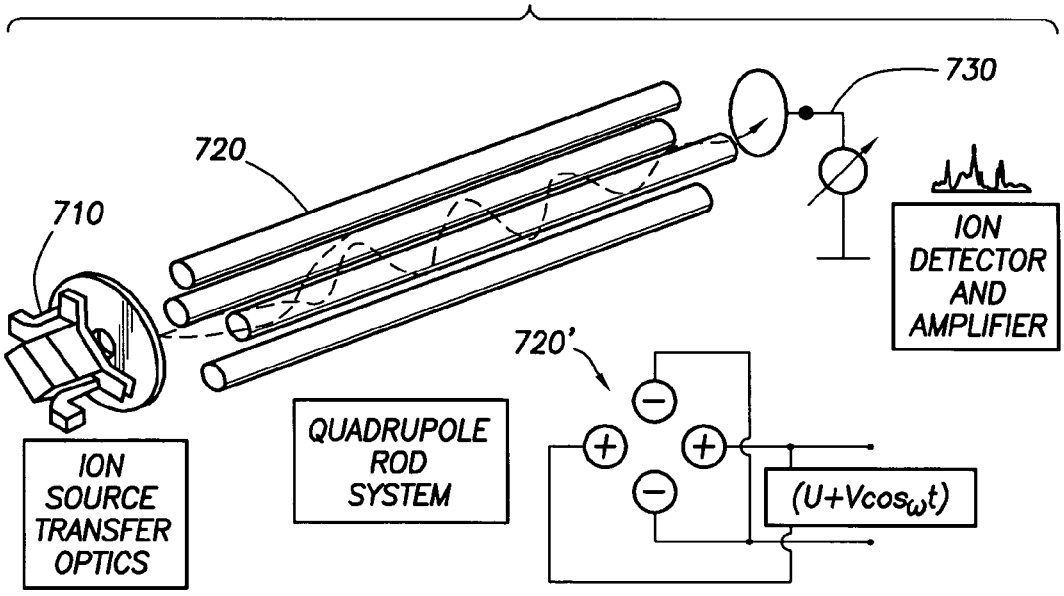

DOWNHOLE MEASUREMENT OF FORMATION CHARACTERISTICS WHILE DRILLING

FIELD OF THE INVENTION

This invention relates to the field of determination of characteristics of formation surrounding an earth borehole and, more particularly, to the determination, using downhole measurements, of such characteristics during the drilling process.

BACKGROUND OF THE INVENTION

Prior to the introduction of Logging While Drilling (LWD) tools and measurements, analysis of cuttings and mud-gas logging were the primary formation evaluation techniques used during drilling. With the advent of LWD, mud-gas logging lost some of its luster and was viewed as a "low technology" discipline. Recently, however, it has come back in favor; as operators have been able to extract valuable reservoir information that they have not been able to obtain by other relatively inexpensive methods.

The present-day approach to mud-gas logging is fundamentally the same as it has traditionally been: extract and capture a surface sample of gas or hydrocarbon liquid vapor from the returning mud line and analyze the fluid for its composition by means of chromatography, e.g. gas chromatography (GC). The fluid, because of the extraction methods most commonly used, comprises essentially the hydrocarbon components C1 to C5. A well site measurement of the total organic (combustible) gas (TG) was also, in general, available immediately at the well site. Using the history of the circulation rate and the record of the rate of bit penetration, the depth at which the surface sample was acquired could be roughly estimated.

A difference between present-day and past surface analysis techniques has been the introduction of more precise means for determining the composition output by the GC and to extend the scope of the gas analysis to include carbon isotopic analysis for geochemical purposes. Typically, this is done by the use of a mass spectrometer (MS). To this point, this type of analysis has necessitated the use of specialized, bulky equipment and has required access to a suitably equipped laboratory. The turn-around time for a full analysis by a laboratory has been said to be from two to four weeks from the gathering of the sample to the delivery of the final report. (See, for example, Ellis, L, A Brown, M Schoell and A Uchytil: "Mud gas Isotope Logging (MGIL) Assists in Oil and Gas Drilling operations", Oil and Gas Journal, May 26, 2003, pp 32-41.) With the miniaturization of both GC and MS equipment such analysis is becoming available at the well site, with results available in a matter of hours or less.

The applications claimed for present-day surface mud-gas analysis include at least the following:

1. Identification of productive hydrocarbon bearing intervals, fluid types and fluid contacts;
2. Ability to identify and assess compartmentalization, both vertical and areal;
3. Identification of by-passed/low-resistivity pay;
4. Identification of changes in lithology;
5. The ability to assess the effectiveness of reservoir seals;
6. Identification of the charge history of an accumulation;
7. Determining the thermal maturity of the hydrocarbon identified; and,
8. Geosteering using-gas-while drilling.

The methodology used in going from the simple C1-C5 hydrocarbon component analysis to the capabilities listed above relies on constructing empirically-motivated ratios of combinations of the various hydrocarbon components, plotting these ratios as functions of depth and associating these profiles with the capabilities listed. Examples of these ratios are:

$$W = \frac{C2 + C3 + C4 + C5}{C1 + C2 + C3 + C4 + C5} = \frac{\sum - C1}{\sum}$$

$$B = \frac{C1 + C2}{C3 + C4 + C5} = \frac{C1 + C2}{\sum - (C1 + C2)}$$

$$C = \frac{C4 + C5}{C3}$$

where W, B and C are called, respectively, the "wetness", "balance" and "character" ratios. Other ratios have also been used for both the hydrocarbon species, for example,

C1/C3, C2/C3, TG/Σ, (C4+C5)/(C1+C2);

the non-hydrocarbon species and combinations of the two.

Notwithstanding advances in equipment, techniques, and turnaround time for surface analysis of mud gas and cuttings, certain drawbacks remain. One problem is depth control; that is, the ability to be able to accurately place the location of an acquired sample. In the presently used method, the depth of the origin of the sample is inferred from the circulation rate and the time between when the sample was extracted at surface and when the bit first passed the sampled depth. Given that pump rates are quite inaccurate and the mud properties vary significantly from surface to bottom hole, the depth determination is often unreliable. Moreover, in general, no allowances are made for the diffusion of the gas within the mud or the inhomogeneity in the mixing as the mud travels along the well bore. This becomes particularly important for thin, stacked reservoirs. As the gas concentration in the mud that reaches the surface is lower than it was originally downhole, highly sensitive instrumentation is needed for the uphole analysis.

A further difficulty is that surface samples tend to be diluted with air and this has to be accounted for in the analysis. Not only do the natural gas "reference samples" against which the extracted sample are compared have to be similarly diluted to obtain reliable results—this requires that the concentration of the mud gas be known a priori—but this dilution makes inaccurate or may even nullify the quantification of non-hydrocarbon gases such as nitrogen, helium and carbon dioxide. This drawback involves, more generally, processes which alter the composition of the gas as it travels to surface and, when applicable, as it travels from wellsite to laboratory. Also, one of the uncertainties that arises when performing mud-gas analysis at the surface is determining the true "background" level of the gas. It is known, for example, that not all the gas may be extracted when the mud is recycled through the mud pits and pumped down the drill pipe. This trace of gas can give a false "background" reading.

To somewhat improve on surface and laboratory analysis of mud gas and cuttings, there has been proposed, for example, downhole analysis for carbon dioxide gas, but with limited capability.

It is among the objects of the present invention to provide techniques which address or solve the aforementioned and other drawbacks of prior art techniques.

SUMMARY OF THE INVENTION

In accordance with a form of the invention, a method is set forth for determining a property of formations surrounding an earth borehole being drilled with a drill bit at the end of a drill string, using drilling fluid that flows downward through the drill string, exits through the drill bit, and returns toward the earth's surface in the annulus between the drill string and the borehole, including the following steps: obtaining, downhole near the drill bit, a pre-bit sample of the mud in the drill string as it approaches the drill bit; obtaining, downhole near the drill bit, a post-bit sample of the mud in the annulus, entrained with drilled earth formation, after its egression from the drill bit; implementing pre-bit measurements on the pre-bit sample; implementing post-bit measurements on the post-bit sample; and determining said property of the formations from said post-bit measurements and said pre-bit measurements. [As used herein, "near the drill bit" means within several drill collar lengths of the drill bit.] In the preferred embodiment, the steps of implementing pre-bit measurements on the pre-bit sample and implementing post-bit measurements on the post-bit sample are performed downhole.

In an embodiment of the invention, the step of determining said property of the formations from said post-bit measurements and said pre-bit measurements comprises determining said property from comparisons between said post-bit measurements and said pre-bit measurements; for example, differences or ratios.

In an embodiment of the invention, the step of implementing measurements on said post-bit sample includes separating solid components and fluid components of the post-bit sample, and analyzing said solid components and said fluid components. In this embodiment, the step of analyzing the solid components includes heating the solid components to remove gasses therefrom, and analyzing the gasses. Also in this embodiment, the step of analyzing the fluid components includes extracting components, such as gaseous components, from liquid components of the fluid components, and analyzing the components. The extraction may be selective or automatic. The analysis of the liquid phase, to determine composition and concentration of the constituents, can include, for example, one or more of the following techniques: chromatography (ie. gas), mass spectrometry, optical spectroscopy, selective membranes technology, molecular sieves, volumetric techniques or nuclear magnetic resonance spectroscopy. The analysis of the phase (ie. gas), to determine composition and concentration of the constituents, can include, for example, one or more of the following techniques: gas chromatography, mass spectroscopy, optical spectroscopy, selective membranes technology, molecular sieves, volumetric techniques, or nuclear magnetic resonance spectroscopy.

In accordance with a further form of the invention, a method is set forth for determining a property of formations surrounding an earth borehole being drilled with a drill bit at the end of a drill string, using drilling fluid that flows downward through the drill string, exits through the drill bit, and returns toward the earth's surface in the annulus between the drill string and the borehole, including the following steps: obtaining, downhole near the drill bit, a post-bit sample of the mud in the annulus, entrained with drilled earth formation, after its egression from the drill bit; and implementing downhole post-bit measurements on the post-bit sample, including separating solid components and fluid components of the post-bit sample, and analyzing at least one of said separated components. In an embodiment of this form of the invention, the step of separating solid components includes providing a downhole sieve, and using the sieve in selection of the solid components. Also in this embodiment, the step of implementing post-bit measurements on the post-bit sample comprises providing a downhole mass spectrometer, and implementing analysis of the fluids using the mass spectrometer.

The embodiments hereof are applicable to determination of various formation characteristics including, as non-limiting examples, one or more of the following: fluid content, fluid distribution, seal integrity, hydrocarbon maturity, fluid contacts, shale maturity, charge history, grain cementation, lithology, porosity, permeability, in situ fluid properties, isotopic ratios, trace elements in the solid, mineralogy, or type of clay.

Further features and advantages of the invention will become more readily apparent from the following detailed description when taken in conjunction with the accompanying drawings.

BRIEF DESCRIPTION OF THE DRAWINGS

FIG. 6 is a diagram illustrating part of the gas analysis technique of an embodiment of the invention.

FIG. 7 is a diagram showing elements of a quadrupole mass spectrometer of a type that can be used in practicing an embodiment of the invention.

DETAILED DESCRIPTION

Figure 1:
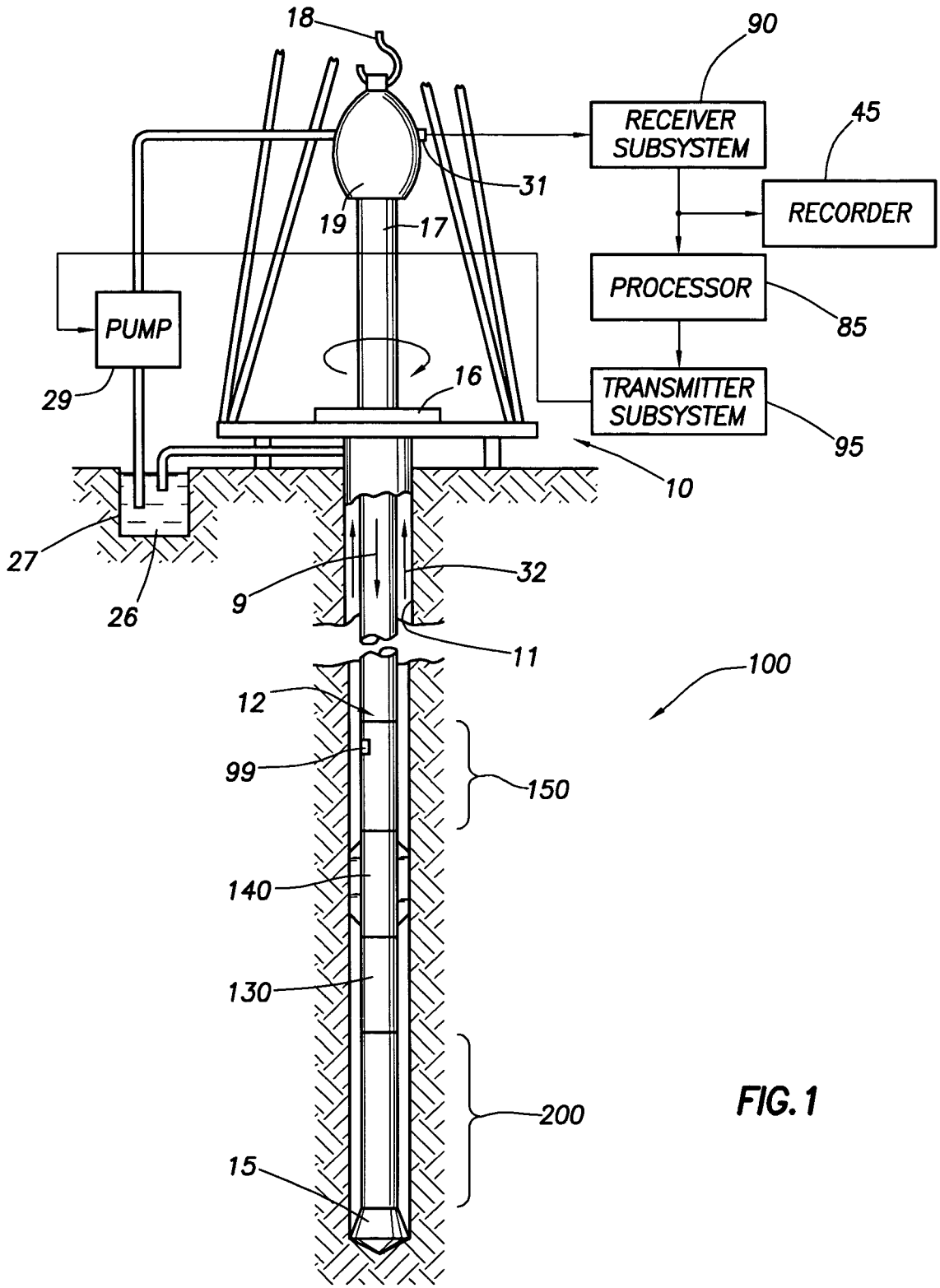
FIG. 1 is a diagram, partially in block form, of a measuring-while-drilling apparatus which can be used in practicing embodiments of the invention.

Referring to FIG. 1, there is illustrated a measuring-while-drilling apparatus which can be used in practicing embodiments of the invention. [As used herein, and unless otherwise specified, measurement-while-drilling (also called measuring-while-drilling or logging-while-drilling) is intended to include the taking of measurements in an earth borehole, with the drill bit and at least some of the drill string in the borehole, during drilling, pausing, sliding and/or tripping.]

A platform and derrick 10 are positioned over a borehole 11 that is formed in the earth by rotary drilling. A drill string 12 is suspended within the borehole and includes a drill bit 15 at its lower end. The drill string 12 and the drill bit 15 attached thereto are rotated by a rotating table 16 (energized by means not shown) which engages a kelly 17 at the upper end of the drill string. The drill string is suspended from a hook 18 attached to a traveling block (not shown). The kelly is connected to the hook through a rotary swivel 19 which permits rotation of the drill string relative to the hook. Alternatively, the drill string 12 and drill bit 15 may be rotated from the surface by a "top drive" type of drilling rig.

Drilling fluid or mud 26 is contained in a pit 27 in the earth. A pump 29 pumps the drilling fluid or mud into the drill string via a port in the swivel 19 to flow downward (arrow 9) through the center of drill string 12. The drilling mud exits the drill string via ports in the drill bit 15 and then circulates upward in the region between the outside of the drill string and the periphery of the borehole, commonly referred to as the annulus, as indicated by the flow arrows 32. The drilling mud thereby lubricates the bit and carries formation cuttings to the surface of the earth. The drilling mud is returned to the pit 27 for recirculation after suitable conditioning. An optional directional drilling assembly (not shown) with a mud motor having a bent housing or an offset sub could also be employed.

Mounted within the drill string 12, preferably near the drill bit 15, is a bottom hole assembly, generally referred to by reference numeral 100, which includes capabilities for measuring, for processing, and for storing information, and for communicating with the earth's surface. [As used herein, "near the drill bit" means within several drill collar lengths from the drill bit.] The assembly 100 includes a measuring and local communications apparatus 200 which is described further hereinbelow. In the example of the illustrated bottom hole arrangement, a drill collar 130 and a stabilizer collar 140 are shown successively above the apparatus 200. The collar 130 may be, for example, a pony collar or a collar housing measuring apparatus which performs measurement functions other than those described herein. The need for or desirability of a stabilizer collar such as 140 will depend on drilling parameters.

Located above stabilizer collar 140 is a surface/local communications subassembly 150. The subassembly 150 can include any suitable type of downhole communication system. Known types of equipment include a toroidal antenna or electromagnetic propagation techniques for local communication with the apparatus 200 (which also has similar means for local communication) and also an acoustic communication system that communicates with a similar system at the earth's surface via signals carried in the drilling mud. Alternative techniques for communication with the surface can also be employed. The surface communication system in subassembly 150 includes an acoustic transmitter which generates an acoustic signal in the drilling fluid that is typically representative of measured downhole parameters.

One suitable type of acoustic transmitter employs a device known as a "mud siren" which includes a slotted stator and a slotted rotor that rotates and repeatedly interrupts the flow of drilling mud to establish a desired acoustic wave signal in the drilling mud. The driving electronics in subassembly 150 may include a suitable modulator, such as a phase shift keying (PSK) modulator, which conventionally produces driving signals for application to the mud transmitter. These driving signals can be used to apply appropriate modulation to the mud siren. The generated acoustic mud wave travels upward in the fluid through the center of the drill string at the speed of sound in the fluid. The acoustic wave is received at the surface of the earth by transducers represented by reference numeral 31. The transducers, which are, for example, piezoelectric transducers, convert the received acoustic signals to electronic signals.

The output of the transducers 31 is coupled to the uphole receiving subsystem 90 which is operative to demodulate the transmitted signals, which can then be coupled to processor 85 and recorder 45. An uphole transmitting subsystem 95 is also provided, and can control interruption of the operation of pump 29 in a manner which is detectable by the transducers in the subassembly 150 (represented at 99), so that there is two way communication between the subassembly 150 and the uphole equipment.

The subsystem 150 may also conventionally include acquisition and processor electronics comprising a microprocessor system (with associated memory, clock and timing circuitry, and interface circuitry) capable of storing data from a measuring apparatus, processing the data and storing the results, and coupling any desired portion of the information it contains to the transmitter control and driving electronics for transmission to the surface. A battery may provide downhole power for this subassembly. As known in the art, a downhole generator (not shown) such as a so-called "mud turbine" powered by the drilling mud, can also be utilized to provide power, for immediate use or battery recharging, during drilling. It will be understood that alternative techniques can be employed for communication with the surface of the earth, such as electromagnetic, drill pipe, acoustic, or other wellbore telemetry systems.

Figure 2:
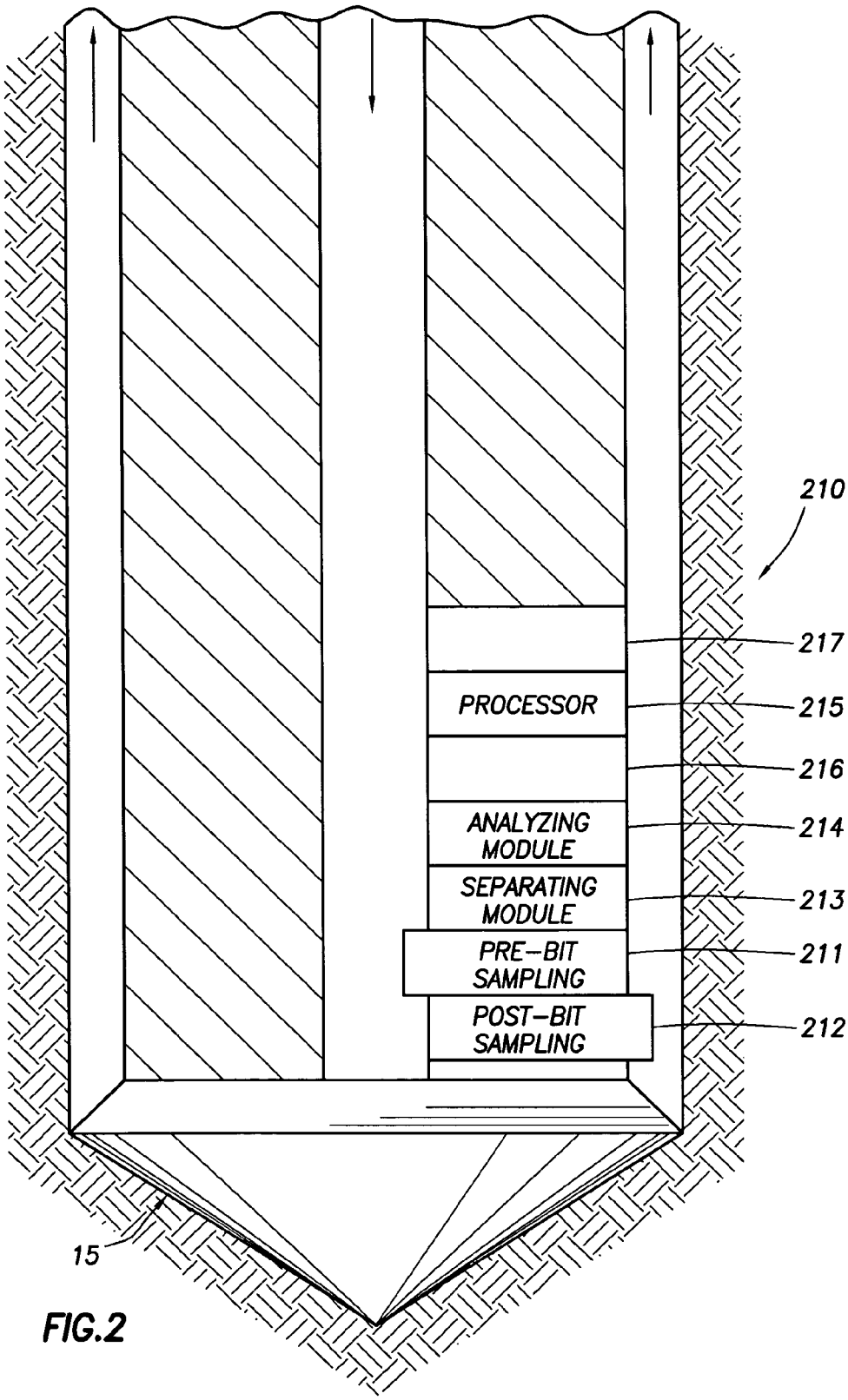
FIG. 2 is a diagram, partially in block form, of a subsystem which can be used in practicing an embodiment of the invention.

Techniques described herein can be performed using various types of downhole equipment. FIG. 2 shows a diagram of a subsystem 210 within the measuring and local communications apparatus 200 of FIG. 1. The modules of subsystem 210 can suitably communicate with each other. The subsystem 210 includes sampling modules 211 and 212. The module 211 samples the mud within the drill collar before it reaches the drill bit 15 to obtain a pre-bit sample, and the module 212 samples the mud, including entrained components, in the annulus after passage through the drill bit 15 to obtain a post-bit sample. It will be understood that the sampling modules 211 and 212 may share at least some components. The subsystem 210 also includes separating and analyzing modules 213 and 214, respectively, and an electronic processor 215, which has associated memory (not separately shown), sample storage and disposition module 216, which can store selected samples and can also expel samples and/or residue to the annulus, and local communication module 217 which communicates with the communications subassembly 150 of FIG. 1. It will be understood that some of the individual modules may be in plural form.

Figure 3:
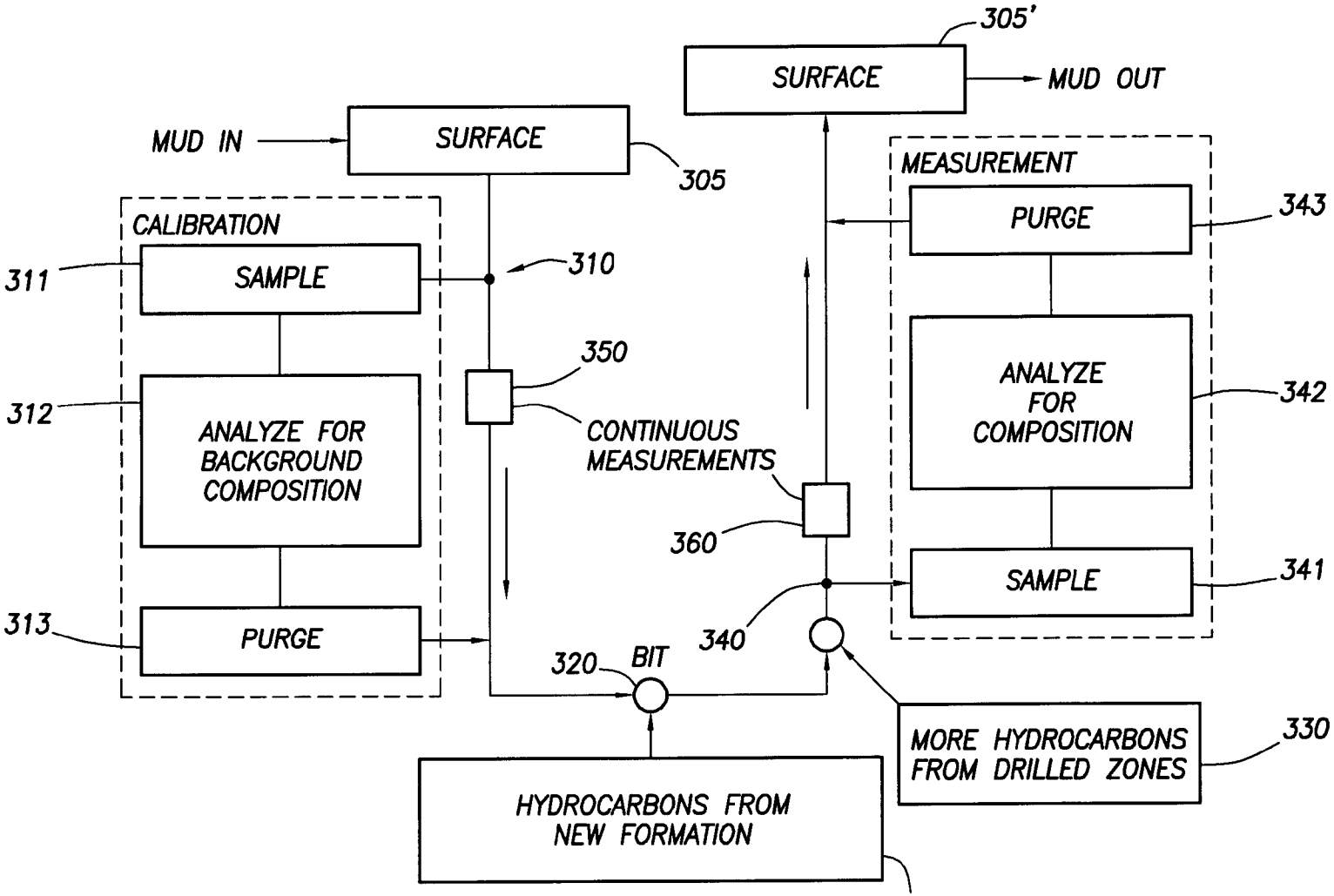
FIG. 3 is a diagram that illustrates the flow of a process in accordance with an embodiment of the invention.

FIG. 3 is a diagram that illustrates a process in accordance with an embodiment of the invention. Drilling mud from a surface location 305 arrives, after travel through the drill string, at a (pre-bit) calibration measurement location 310, where sampling (block 311), analysis for background composition 312, and purging (block 313) are implemented. The mud then passes the drill bit 320, and hydrocarbons (as well as other fluids and solids) from a new formation being drilled into (block 321) are mixed with the mud. The mud in the annulus will also contain hydrocarbon and other components from zones already drilled through (block 330). The mud in the annulus arrives at (post-bit) measurement location 340, where sampling (block 341), analysis for composition (block 342) and purging (block 343) are implemented, and the mud in the annulus then returns toward the surface (305'). The processor 215 (FIG. 2), in response to the pre-bit calibration and post-bit measurement values, can determine incremental hydrocarbon and other entrained components which entered the mud from the drill zones, as a function of the comparisons between post-bit and pre-bit measurements.

Figure 4:
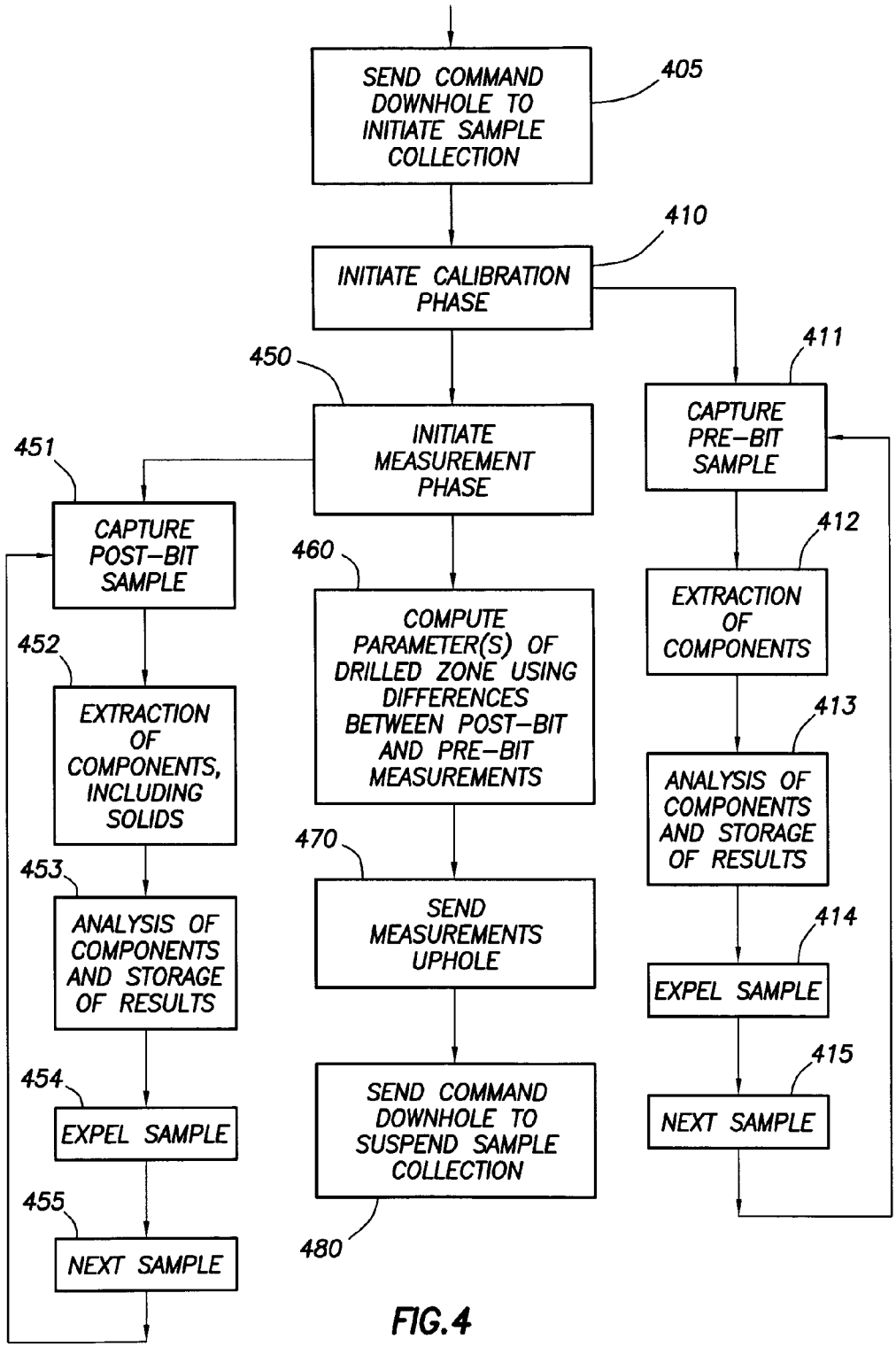
FIG. 4 is a flow diagram of a routine for controlling the processors of the described system in accordance with an embodiment of the invention.

FIG. 4 is a flow diagram of a routine for controlling the uphole and downhole processors in implementing an embodiment of the invention. The block 405 represents sending of a command downhole to initiate collection of samples at pre-selected times and/or depths. A calibration phase is then initiated (block 410), and a measurement phase is also initiated (block 450). The calibration phase includes blocks 410-415.

The block 411 represents capture (by module 211 of FIG. 2) of a sample within the mud flow in the drill collar before it reaches the drill bit. Certain components are extracted from the mud (block 412), and analysis is performed on the pre-bit sample using the analysis module(s) 213 of FIG. 2, as well as storage of the results as a function of time and/or depth (block 413). The block 414 represents expelling of the sample (although here, as elsewhere, it will be understood that some samples, or constituents thereof, may be retained). Then, if this part of the routine has not been terminated, the next sample (block 415) is processed, beginning with re-entry to block 411.

The measurement phase, post-bit, includes blocks 451-455. The block 451 represents capture (by module 212 of FIG. 2) of a post-bit sample within the annulus, which will include entrained components, matrix rock and fluids, from the drilled zone. The block 452 represents extraction of components, including solids and fluids, and analysis is performed using the analysis module(s) 213 of FIG. 2, as well as storage of the results as a function of time and/or depth (block 453). The sample can then be expelled (block 454). (Again, if desired, some samples, or constituents thereof, can be retained.) Then, if this part of the routine has not been terminated (e.g. by command from uphole and/or after a predetermined number of samples, an indication based on a certain analysis result, etc.), the next sample (block 455) is processed, beginning with re-entry to block 451.

The block 460 represents computation of parameter(s) of the drilled zone using comparisons between the post-bit and pre-bit measurements. The block 470 represents the transmission of measurements uphole. These can be the analysis measurements, computed parameters, and/or any portion or combination thereof. Uphole, the essentially "real time" measurements can, optionally, be compared with surface mud logging measurements or other measurements or data bases of known rock and fluid properties (e.g. fluid composition or mass spectra). The block 480 represents the transmission of a command downhole to suspend sample collection until the next collection phase.

Further description of the routine of FIG. 4 will next be provided.

Regarding the command to the downhole tool to initiate sampling and analysis, the decision as to when to take a sample, or the frequency of sampling, can be based on various criteria; an example of one such criterion being to downlink to the tool every time a sample is required; another example being to take a sample based on the reading of some open hole logs, e.g. resistivity, NMR, and/or nuclear logs; yet another example being to take a sample based on a regular increment or prescribed pattern of measured depths or time.

Figure 5:
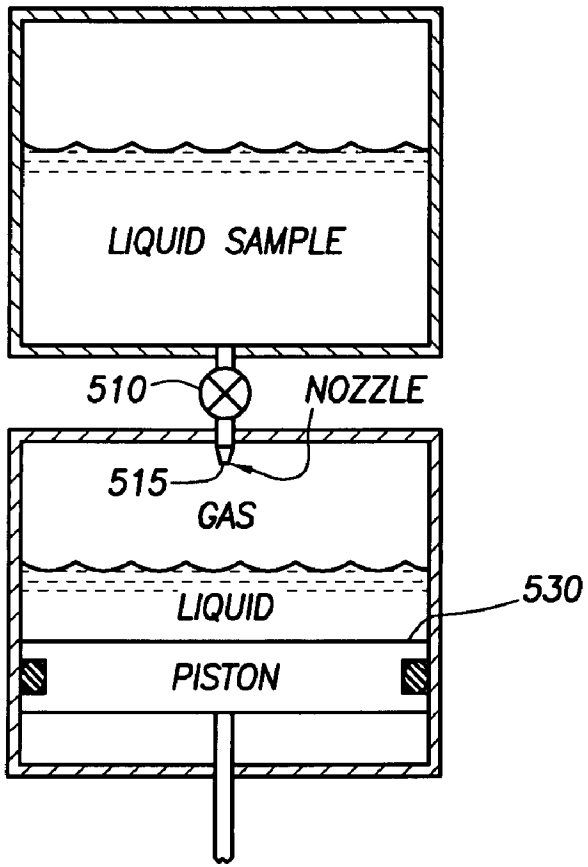
FIG. 5 illustrates how a use of a nozzle and lower pressure can be used to extract gas from a liquid sample or a liquid component of a sample.

After the sample is captured, a first extraction step comprises extracting, from the sample, gases which are present, and volatile hydrocarbon components as a gas. When extraction is performed at the surface, a "standard" first step comprises dropping the pressure in the mud return line and flashing the gas into a receptacle. To improve the extraction of gases, agitators of various forms can be used. For volatile, and not so volatile liquids, steam stills have been employed. To expand the volume of a mud sample captured within a down hole tool, a cylinder and piston device can be used (see, for example, U.S. Pat. No. 6,627,873). Other methods can be used, such as a reversible down hole pump, or gas selective membranes, one for each gas (see, for example, Brumboiu Hawker, Norquay and Wolcott: "Application of Semipermeable Membrane Technology in the Measurement of Hydrocarbon Gases in Drilling Fluid", SPE paper 62525, June 2000). Alternatively, the liquid sample can be passed through a nozzle into a second chamber of lower pressure, as shown in FIG. 5, which includes valve 510, nozzle 515, and piston 530. This insures that the gas from all the liquid volume has been extracted and does not rely on stirring the sample. A simple pressure reduction can work well for small volume samples, but when the sample volume is large the sample generally needs to be stirred. Other types of mechanical separation such as centrifuging, can also be used. As shown in FIG. 6, once the volatiles have been extracted, they can be passed through moisture absorbing column, commonly known as desiccant, and then forwarded to the gas separation and measurement system, such as FTIR and/or quadrupole MS.

After hydrocarbons and other gases have been extracted, at least a C1-C8 compositional analysis on the extracted hydrocarbons is performed and an analysis for gases such as carbon-dioxide, nitrogen, hydrogen sulphide, etc., can also be performed. These steps involve either separation followed by measurement of individual components or using measurement techniques that can make measurements on the whole sample without a need for separation.

The standard technique for separating the components uphole is the gas chromatograph (GC). It is advantageous, however, to employ a method which does not require gross separation or wherein the separation process does not require a carrier fluid. There are several ways to analyze the output of the GC. The normal retention-time analysis for the identification of the constituent components, which employs a flame ionization detector device is not preferred for down hole operations. Most recently, mass spectrometry detection has been used uphole for the positive identification of the constituents. Although GC is an excellent choice for gas separation/identification, a mass spectrometer by itself can suffice, and is part of a preferred embodiment hereof. Associated with the mass spectrometer are an ionization chamber, a vacuum system and a detector/multiplier array. A quadrupole mass spectrometer (QMS) is a suitable type for a preferred embodiment hereof. In the operation of a QMS, the molecules are first ionized using RF radiation (or other suitable methods), the ions are sent though a quadruple filter where the mass to charge ratio (m/z) is selected, and is guided to the detection system. The basic components of QMS are shown in FIG. 7, including ion source and transfer optics 710, quadrupole rod system 720, and ion detector and amplifier 730. Also shown at 720' is a circuit diagram of the four quadrupole rods, excited by RF voltage and a superimposed DC voltage. Note that QMS includes separation and measurement all together although the separation is internal to the operation of the device. In one mode of operation the m/z is scanned over the range of interest and the complete spectrum is produced in which the intensity of each peak vs m/z is given. For molecules that have masses of 1-200 Dalton, the scan typically takes close to 1 minute. This mode is particularly useful when a new zone is encountered where there is a possibility of finding a new, unexpected compound. When one expects the same constituents but their relative concentration varies as a function of depth, the discrete mode can be used. In this mode the quadruple filter jumps between a pre-selected set of m/z and for each case reports the concentration as a function of time. The preferred embodiment hereof has both these modes, allowing the user, or an automated procedure in the tool, to select a combination of the two based on the geological features and/or the output of other logs. The dimensions of existing QMS equipment are amenable to inclusion in a logging-while-drilling tool. See, for example, the QMS sold by Hiden Analytical of Peterborough, N.H.

Although a QMS is utilized in a preferred embodiment hereof, it will be understood that other devices and methods can be used, some examples of which are as follows:

i) Optical spectroscopy: FTIR, GC-FTIR, ultraviolet and fluorescence spectroscopy. FTIR is a versatile and useful technique when the analysis of all the components is of interest. The Optical Spectroscopy methods do not need separation of the sample into its constituents.

ii) Nuclear magnetic resonance (NMR), can be used when more detailed analysis is required. For example if the concentration of different isomers of the same hydrocarbon is desired, a proton NMR will be useful. The limitation of proton NMR is its insensitivity to carbon dioxide, N2, He, and other gases not containing protons. Another attractive feature of having NMR downhole is that it can be used to analyze the solids and provide fluid viscosity.

iii) Molecular sieve techniques; these techniques are best suited for separation of the constituents. There is then a need for other methods to perform the measurement step.

iv) Combinations of the above; There are some cases where enhanced accuracy is needed. For example if one of the components is critical, yet it is of very small concentration, it may be desirable to combine some of the described methods.

v) Inclusion of a density, resistivity, dielectric permittivity, NMR, sonic velocity, etc. measurement; this is a relatively simple measurement to instrument and gives valuable information, which may sometimes be redundant but can be used for quality control (QC) purposes.

vi) Total gas measurement. This can provide PVT information under downhole conditions.

It can also be advantageous to have a capability of geochemical analysis, employing, for example, carbon, hydrogen, sulphur, other elements, and isotope analysis. A mass spectrometer is generally required. For example, carbon isotope analysis is performed to, in particular, determine the change in the relative abundance of 13C in a sample from which deductions are made regarding the contents, source and maturity of the hydrocarbons in a reservoir. This is another advantage of the QMS of the preferred embodiment hereof.

Figure 12:
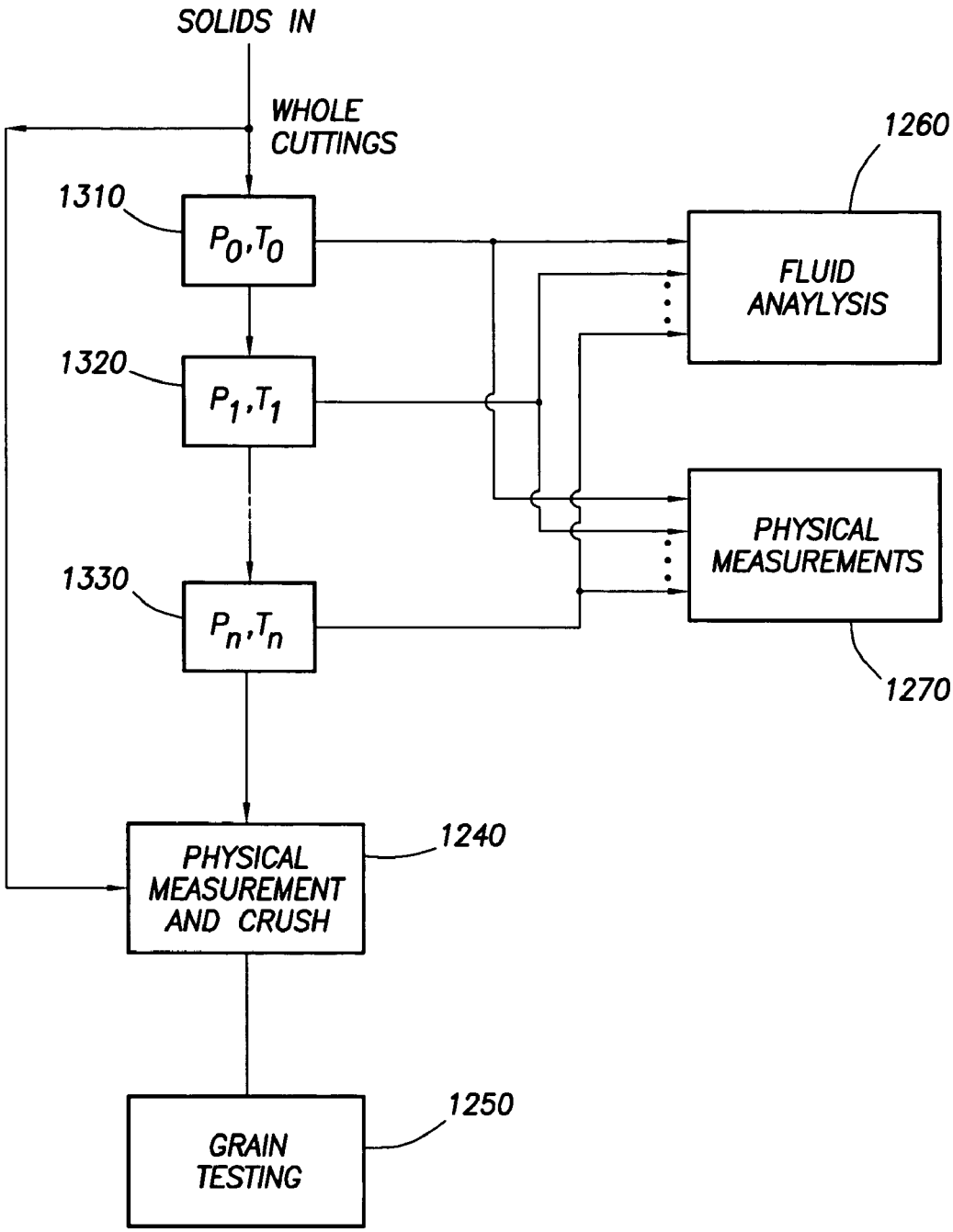
FIG. 12 is a diagram, partially in block form, illustrating analysis of solids in accordance with an embodiment of the invention.

A further portion of the extraction and analysis involves performing one or more subsequent extraction steps including heating the sample to a specified temperature to create volatile components of successively higher molecular weight (see also FIG. 12). Extraction of non-volatile liquids requires boiling the liquids off which, in turn, requires that the temperature be increased, the pressure dropped, or both. Higher temperature of downhole environment helps with this step. Further temperature increase can be achieved, for example, by electrical heating of the sample container. The boiled liquids at the temperature of interest can be collected in a separate container to be measured as described next.

A C1-Cn compositional analysis, where n is greater than 8, can also be performed. The measurement involves bringing the liquid to temperature and pressure above the boiling point and recording P, V, and T to determine the band of hydrocarbons. Once the liquid is in gas phase, QMS, or other described techniques, can be used for more detailed analysis, and to identify individual hydrocarbons and measure their relative concentrations. This step requires the use of the same class of equipment as described above but, capable of handling a larger range of molecular weights and operating at higher temperatures.

Regarding the capture of a sample, in the annulus, and as close to the bit as possible, of the mud with entrained components, in an embodiment hereof, the sample may be collected between the channels of a stabilizer behind the bit. The uncertainty in the position of the sample will depend on how close to the drill bit the sample is taken, and the mud flow rate. The resolution depends on the penetration rate and how quickly the analysis can be performed.

Figure 8:
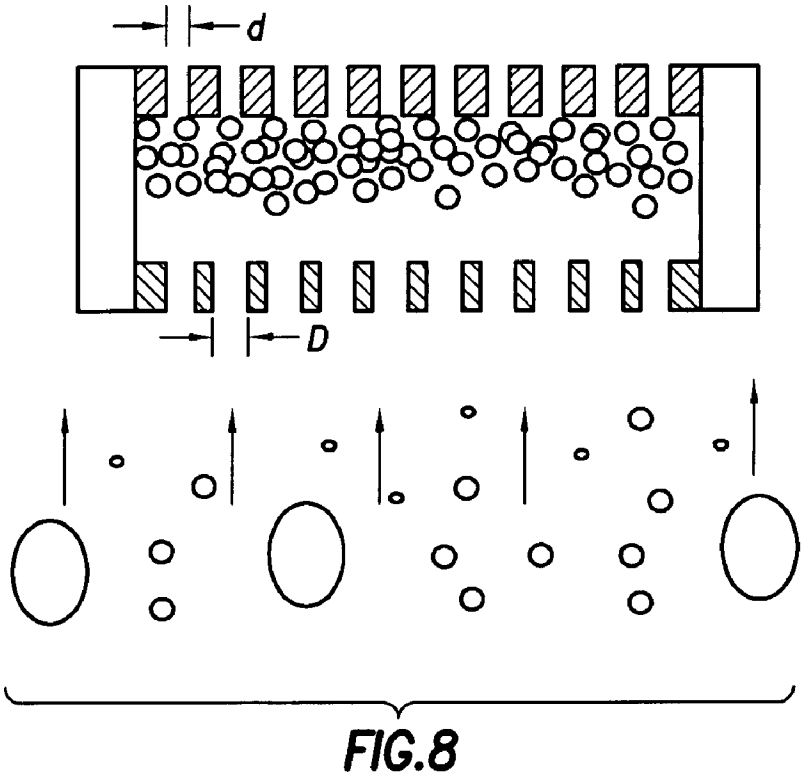
FIG. 8 illustrates, in cross section, separation of cuttings from mud and selection of a band of cuttings by selecting particle sizes greater than d and less than or equal to D.
Figure 9:
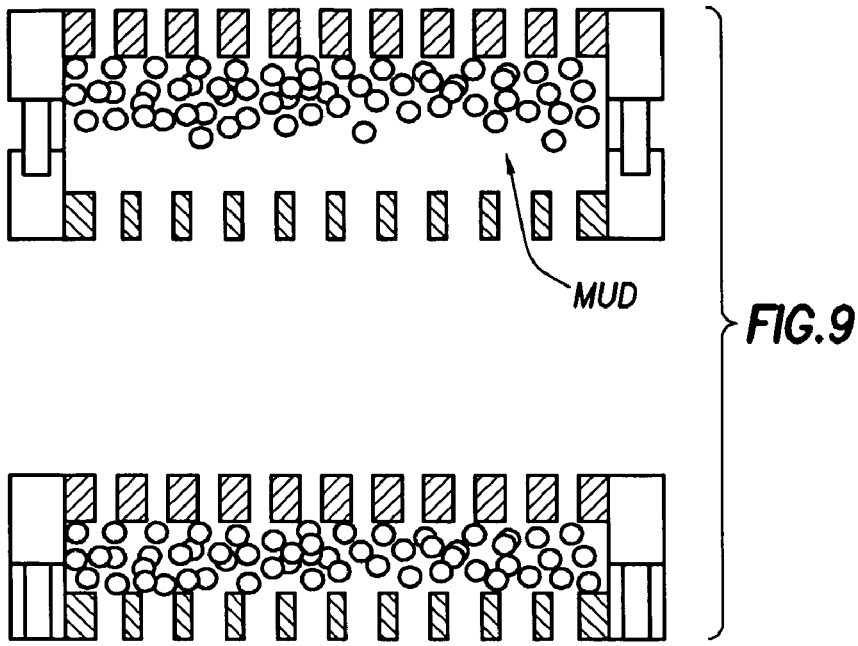
FIG. 9 is a diagram showing, in cross section, how the sieves of FIG. 8, shown again in 9(*a*), can be moved together, as seen in 9(*b*), to squeeze out excess mud and compact the cuttings.
Figure 10:
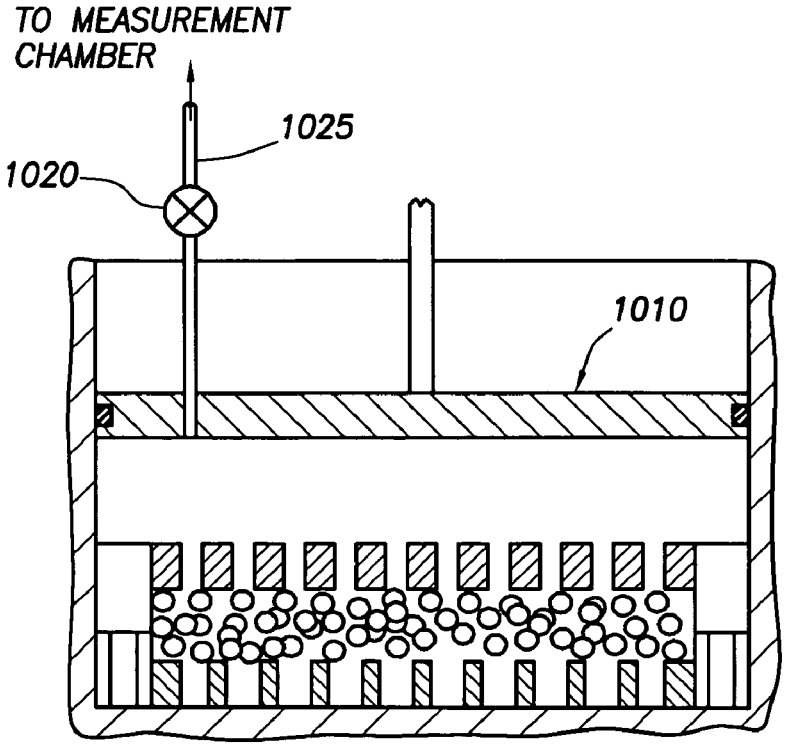
FIG. 10 is a diagram showing, in cross section, how fluids extracted using the equipment of FIGS. 8 and 9, can be transferred to a measurement chamber.

The mud, with entrained components, is processed to separate solid components, including mud solids and drill cuttings, from the fluid (gas and liquid) components of the mud. A simple, coarse filter can be used to separate the mud from the cuttings. The method of separating gas from the mud is the same as described above with reference to the calibration stage. A sample of cuttings can be obtained using the device and technique illustrated in FIGS. 8 and 9. The average size of cutting pieces in the sample is important. For very small cutting sizes, the initial spurt invasion has replaced the native fluids in the rock with the mud filtrate the analysis of which has its own, albeit limited, use. On the other hand very large cuttings may not fit into the chambers used for analysis and can create a problem. Thus, there is a range of cutting sizes that is useful. As FIGS. 8 and 9 show, the fluid is passed through a set of two sieves, the first of which selects the small cuttings up to the largest target size. This upper limit dimension is determined by the detail design of the subsequent chambers. The second sieve, located further down the line is chosen such that all the smaller particles pass through. As a result, a band of cutting sizes is retained in the device. Once a pre-determined height of cutting samples is collected, the two sieves are pushed together to squeeze most of the fluids out, leaving substantially solid sample. FIG. 10 shows how the fluids are transferred to a measurement chamber. During the up stroke of piston 1010, the valve 1020 is closed. The down stroke of piston 1010 is implemented with the valve 1020 open, so the fluids are evacuated through tube 1025 to the measurement chamber.

Figure 11:
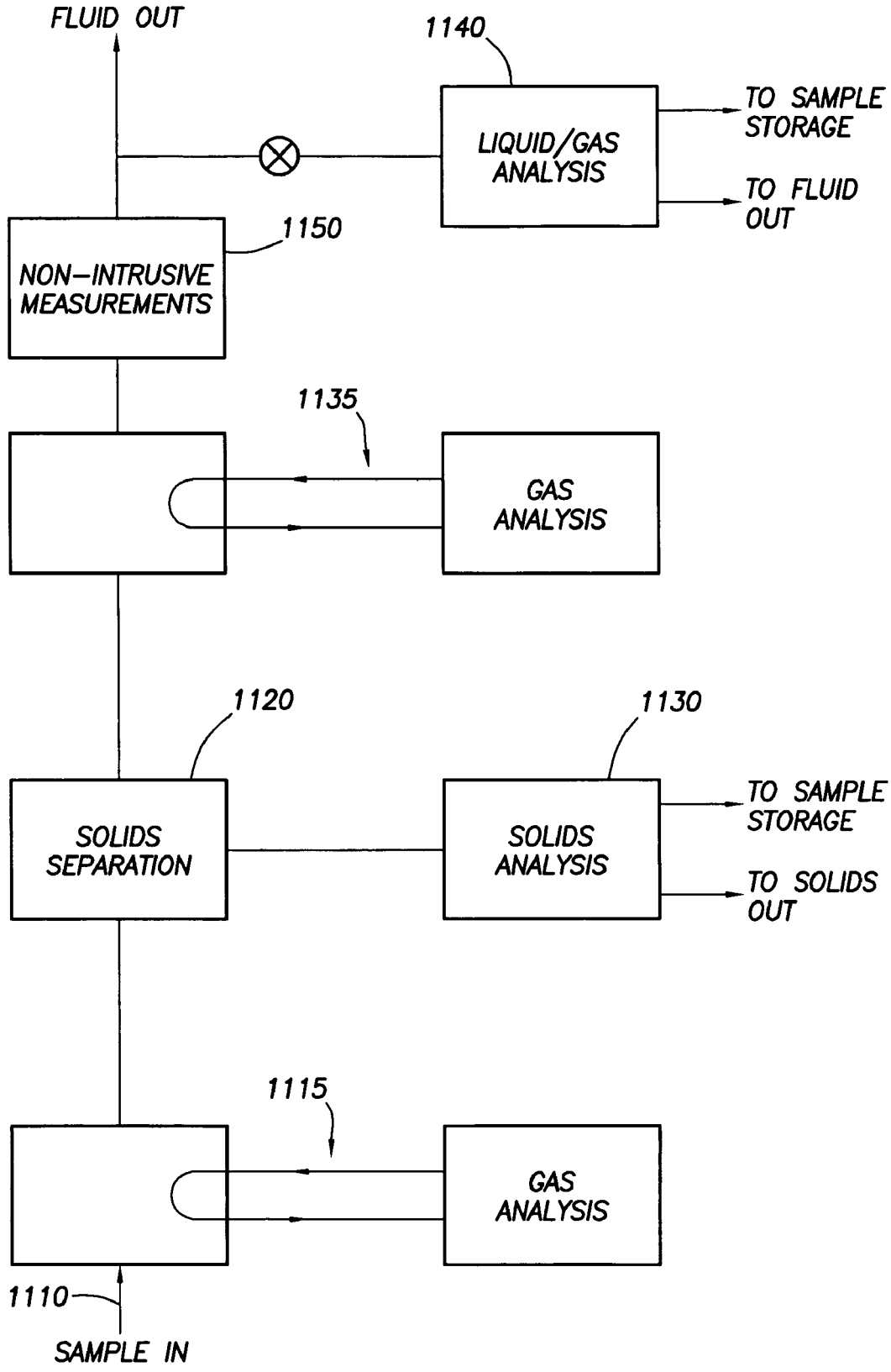
FIG. 11 is a diagram, partially in block form, illustrating sample analysis in accordance with an embodiment of the invention.

FIG. 11 is a diagram of a sample analyzer procedure for pre-bit and/or post-bit samples, that can be used in practicing an embodiment of the invention. The sample enters at line 1110, and is subject to gas analysis, e.g. using selective membranes, at 1115 to obtain parameters such as molecular composition. Solids separation and solids analysis, as previously described, are represented at 1120 and 1130, respectively, and the gas and liquid products are analyzed at 1135 and 1140, respectively. Also, non-intrusive measurements, stationary or flowing, such as resistivity, neutron-density, NMR, etc. can be performed on the fluids, as represented at 1150.

The solids analysis as represented by block 1130 of FIG. 2, and previously described, is further illustrated in FIG. 12. The separated solids are subjected to successively stepped pressure and temperature combinations, $P^0T^0$, $P^1T^1$ . . . $P^NT^N$, as represented at 1210, 1220, . . . 1230. The outputs at the various stages are coupled to both blocks 1260 and 1270. The block 1260 represents analysis of the fluids to obtain parameters such as molecular composition, isotopic analysis readings, etc., and the block 1270 represents physical measurements, such as NMR, X-ray, nuclear, etc. to determine parameters such as porosity, permeability, bulk density, viscosity, capillary pressure, etc. The previously described analysis of the remaining matrix and the subsequent crushed grain (e.g. to determine grain density, lithology, mineralogy, grain size, etc.) can then be implemented. For example, in FIG. 12, the block 1240 represents physical testing on the rock (whole cuttings, and/or with volatiles at least partially removed), to determine parameters such as compressive strength. After the rock is crushed, the grain can also be tested (block 1250) to obtain parameters such as grain density, lithology, mineralogy, grain size, etc.

The invention has been described with reference to particular preferred embodiments, but variations within the spirit and scope of the invention will occur to those skilled in the art. For example, while rotary mechanical drilling is now prevalent, it will be understood that the invention can have application to other types of drilling, for example drilling using a water jet or other means.

We claim:

1. A method for determining a property of formations surrounding an earth borehole being drilled with a drill bit at the end of a drill string, using drilling fluid that flows downward through the drill string, exits through the drill bit, and returns toward the earth's surface in the annulus between the drill string and the periphery of the borehole, comprising the steps of:

obtaining, downhole near the drill bit, a pre-bit sample of the mud in the drill string as it approaches the drill bit;

obtaining, downhole near the drill bit, a post-bit sample of the mud in the annulus, entrained with drilled earth formation, after its egression from the drill bit;

implementing pre-bit measurements on the pre-bit sample;

implementing post-bit measurements on the post-bit sample; and determining said property of the formations from said post-bit measurements and said pre-bit measurements;

wherein said steps of implementing pre-bit measurements on the pre-bit sample and implementing post-bit measurements on the post-bit sample are performed downhole; and wherein said step of determining said property of the formations from said post-bit measurements and said pre-bit measurements comprises determining said property from ratios of said post-bit measurements and said pre-bit measurements.

2. The method as defined by claim 1, wherein said step of determining said property of the formations from said post-bit measurements and said pre-bit measurements is performed downhole.

3. The method as defined by claim 2, further comprising transmitting uphole said determined property of the formations.

4. The method as defined by claim 1, further comprising transmitting uphole one of said property, said pre-bit measurements, said post-bit measurements and combinations thereof.

5. The method as defined by claim 1, wherein said step of determining said property of the formations comprises determining a plurality of properties of the formations.

6. The method as defined by claim 1, wherein said step of determining said property comprises determining the composition of one of the pre-bit sample, the post-bit sample and combinations thereof.

7. A method for determining a property of formations surrounding an earth borehole being drilled with a drill bit at the end of a drill string, using drilling fluid that flows downward through the drill string, exits through the drill bit, and returns toward the earth's surface in the annulus between the drill string and the periphery of the borehole, comprising the steps of:

obtaining, downhole near the drill bit, a post-bit sample of the mud in the annulus, entrained with drilled earth formation, after its egression from the drill bit; and implementing downhole post-bit measurements on the post-bit sample, including separating solid components and fluid components of the post-bit sample, and analyzing at least one of said separated components.

8. The method as defined by claim 7, further comprising determining said property from the result of the analysis of said at least one of the separated components.

9. The method as defined by claim 7 wherein said step of separating solid components includes separating solids within a given range of sizes.

10. The method as defined by claim 7, wherein said step of separating solid components includes providing a downhole sieve, and using said sieve in selection of said solid components.

11. The method as defined by claim 7, wherein said step of separating solid components comprises separating using a centrifuge.

12. The method as defined by claim 7, wherein said step of implementing downhole measurements on said post-bit sample includes heating said solid components to remove fluids therefrom, and analyzing said fluids.

13. The method as defined by claim 12, wherein said step of analyzing fluid components includes heating said fluid components to obtain a vapor, and analyzing said vapor.

14. The method as defined by claim 13, further comprising repeating said heating said fluid components and analyzing said vapor steps at a higher temperature.

15. The method as defined by claim 12, wherein said step of analyzing said fluids is implemented using selective membranes.

16. The method as defined by claim 7, wherein said step of implementing downhole measurements on said post-bit sample includes analyzing said fluid components by extracting components from liquid components of said fluid components, and analyzing said components.

17. The method as defined by claim 7, wherein said step of implementing post-bit measurements on the post-bit sample comprises providing a downhole mass spectrometer, and implementing analysis of said fluids using said downhole mass spectrometer.

18. The method as defined by claim 7, further comprising obtaining, downhole near the drill bit, a pre-bit sample of the mud in the drill string as it approaches the drill bit; and of determining the composition of one of the pre-bit sample, the post-bit sample and combinations thereof.

19. The method as defined by claim 18, further comprising transmitting uphole one of said property, pre-bit measurements, post-bit measurements and combinations thereof.

20. A method for determining a property of formations surrounding an earth borehole being drilled with a drill bit at the end of a drill string, using drilling fluid that flows downward through the drill string, exits through the drill bit, and returns toward the earth's surface in the annulus between the drill string and the borehole, comprising the steps of:

obtaining, downhole near the drill bit, a post-bit sample of the mud in the annulus, entrained with drilled earth formation, after its egression from the drill bit;

providing a downhole mass spectrometer; and implementing downhole post-bit measurements on the post-bit sample with said mass spectrometer.

21. The method as defined by claim 20, further comprising transmitting uphole said post-bit measurements.

22. A method for determining a property of formations surrounding an earth borehole being drilled with a drill bit at the end of a drill string, using drilling fluid that flows downward through the drill string, exits through the drill bit, and returns toward the earth's surface in the annulus between the drill string and the periphery of the borehole, comprising the steps of:

obtaining, downhole near the drill bit, a pre-bit sample of the mud in the drill string as it approaches the drill bit;

obtaining, downhole near the drill bit, a post-bit sample of the mud in the annulus, entrained with drilled earth formation, after its egression from the drill bit;

implementing pre-bit measurements on the pre-bit sample;

implementing post-bit measurements on the post-bit sample; and determining said property of the formations from said post-bit measurements and said pre-bit measurements;

wherein said steps of implementing pre-bit measurements on the pre-bit sample and implementing post-bit measurements on the post-bit sample are performed downhole; and wherein said step of implementing measurements on said post-bit sample includes separating solid components and fluid components of the post-bit sample, and analyzing said solid components.

23. The method as defined by claim 22, wherein said step of determining said property of the formations from said post-bit measurements and said pre-bit measurements is performed downhole.

24. The method as defined by claim 22, further comprising transmitting uphole one of said property, said pre-bit measurements, said post-bit measurements and combinations thereof.

25. The method as defined by claim 22, wherein said step of determining said property of the formations from said post-bit measurements and said pre-bit measurements comprises determining said property from at least one of comparisons, differences, and ratios between said post-bit measurements and said pre-bit measurements.

26. The method as defined by claim 22, wherein said step of implementing post-bit measurements on the post-bit sample comprises providing a downhole mass spectrometer, and implementing said measurements using said mass spectrometer.

27. The method as defined by claim 22, wherein said step of determining said property comprises determining the composition of one of the pre-bit sample, the post-bit sample and combinations thereof.

28. The method as defined by claim 22, said step of analyzing said solid components includes heating said solid components to remove fluids therefrom, and analyzing said fluids.

29. The method as defined by claim 22, wherein said step of separating solid components includes separating solids within a given range of sizes.

30. The method as defined by claim 22, wherein said step of separating solid components includes providing a downhole sieve, and using said sieve in selection of said solid components.

31. The method as defined by claim 22, wherein said step of separating solid components comprises separating using a centrifuge.

32. The method as defined by claim 22, wherein said step of implementing measurements on said post-bit sample includes analyzing said fluid components.

33. The method as defined by claim 32, wherein said step of analyzing said fluid components is implemented using selective membranes.

34. The method as defined by claim 32, wherein said step of analyzing said fluid components includes extracting components from liquid components of said fluid components, and analyzing said components.

* * * * *